US011308892B2

(12) United States Patent
Cho et al.

(10) Patent No.: US 11,308,892 B2
(45) Date of Patent: Apr. 19, 2022

(54) ORGANIC LIGHT EMITTING DISPLAY DEVICE AND DRIVING METHOD THEREOF

(71) Applicant: LG Display Co., Ltd., Seoul (KR)

(72) Inventors: Kyung-Hyun Cho, Jeongeup-si (KR); Jae-Deok Ko, Paju-si (KR); Seong-Eok Han, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/102,124

(22) Filed: Nov. 23, 2020

(65) Prior Publication Data

US 2021/0166637 A1 Jun. 3, 2021

(30) Foreign Application Priority Data

Dec. 3, 2019 (KR) ..... 10-2019-0158756

(51) Int. Cl.
*G09G 3/3208* (2016.01)
*G09G 3/3291* (2016.01)
(Continued)

(52) U.S. Cl.
CPC ..... *G09G 3/3291* (2013.01); *G09G 3/3258* (2013.01); *G09G 3/3266* (2013.01);
(Continued)

(58) Field of Classification Search
CPC .. G09G 3/3208; G09G 3/3233; G09G 3/3258; G09G 3/3266; G09G 3/3291; G09G 3/006; G09G 2300/0439; G09G 2310/08; G09G 2310/0291; G09G 2320/0285; G09G 2320/029; G09G 2320/0295; G09G 2320/0693; G09G 2330/08; G09G 2330/10; G09G 2330/12; H01L 21/66; H01L 22/30; H01L 51/0031; H01L 2251/568
See application file for complete search history.

(56) References Cited

U.S. PATENT DOCUMENTS 9,378,678 B1 6/2016 Lee et al.
9,601,058 B2 3/2017 Lee et al.
(Continued)

FOREIGN PATENT DOCUMENTS

KR 10-2016-0050832 A 5/2016
KR 10-2016-0083590 A 7/2016
KR 10-2017-0023292 A 3/2017

*Primary Examiner* — Michael J Eurice
(74) *Attorney, Agent, or Firm* — Fenwick & West LLP

(57) ABSTRACT

The disclosure relates to an organic light emitting display device that can detect a defect in a scan transistor in the device in which the scan transistor and a sensing transistor simultaneously operate, and the device includes: an OLED in a subpixel; a driving transistor connected between the OLED and a driving voltage line; a scan transistor connected between a first node through which a data voltage is applied to the driving transistor and a data line; a sensing transistor connected between a second node between the driving transistor, the OLED, and a reference voltage line; and a defect detector for applying the data voltage in a state in which both the scan transistor and the sensing transistor are turned off and then detecting an amount of charges charged in a parasitic capacitor of the OLED to determine whether the scan transistor is defective due to foreign substances.

12 Claims, 7 Drawing Sheets

(51) Int. Cl.
*G09G 3/3258* (2016.01)
*G09G 3/3266* (2016.01)

(52) U.S. Cl.
CPC ... *G09G 3/3208* (2013.01); *G09G 2310/0291* (2013.01); *G09G 2310/08* (2013.01); *G09G 2330/12* (2013.01)

(56) References Cited

U.S. PATENT DOCUMENTS

| | | | | |
|---|---|---|---|---|
| 9,881,555 | B2 | 1/2018 | Park et al. | |
| 2008/0198103 | A1* | 8/2008 | Toyomura | G09G 3/3233 345/77 |
| 2013/0050292 | A1* | 2/2013 | Mizukoshi | G09G 3/3291 345/690 |
| 2015/0294626 | A1* | 10/2015 | Bi | G09G 3/3233 345/211 |
| 2016/0012799 | A1* | 1/2016 | Kim | G09G 3/3208 345/205 |
| 2016/0062548 | A1* | 3/2016 | Kwon | G06F 3/042 345/173 |
| 2016/0125811 | A1 | 5/2016 | Park et al. | |
| 2016/0189612 | A1* | 6/2016 | Lee | G09G 3/2003 345/690 |
| 2016/0275871 | A1 | 9/2016 | Lee et al. | |
| 2017/0025061 | A1* | 1/2017 | Takizawa | G09G 3/3291 |
| 2018/0025798 | A1* | 1/2018 | Rhodes | G21D 1/02 210/137 |
| 2018/0061292 | A1* | 3/2018 | Hong | G09G 3/006 |
| 2021/0201810 | A1* | 7/2021 | Feng | G09G 3/3233 |

* cited by examiner

ORGANIC LIGHT EMITTING DISPLAY DEVICE AND DRIVING METHOD THEREOF

CROSS-REFERENCE TO RELATED APPLICATION

This application claims priority from Republic of Korea Patent Application No. 10-2019-0158756 filed on Dec. 3, 2019, which is incorporated by reference in its entirety.

BACKGROUND

Field of Technology

The present disclosure relates to an organic light emitting display device and a driving method thereof, and more specifically, to an organic light emitting display apparatus and a driving method thereof which can detect defects in scan transistors in an organic light emitting display apparatus in which scan transistors and sensing transistors are simultaneously driven.

Discussion of the Related Art

With the development of the information society, various demands for display devices displaying images are increasing and various types of display devices such as a liquid crystal display, a plasma display panel, and an organic light emitting display device are used.

Among such display devices, an organic light emitting display device using organic light emitting diodes (OLEDs) that spontaneously emit light has the advantages of high response speed, high dynamic range, high emission efficiency, high luminance and a wide viewing angle.

Such an organic light emitting display device has subpixels which include OLEDs and driving transistors for driving the OLEDs and are arranged in a matrix and displays an image by controlling the brightness of subpixels selected through a scan signal according to grayscale of data.

Each subpixel includes a scan transistor that operates by a scan signal and controls a data voltage applied to the driving transistor, a capacitor for maintaining the data voltage applied to the driving transistor for one frame, a sensing transistor connected to a reference voltage line, and the like in addition to the OLED and the driving transistor.

A defect may be generated in the aforementioned circuit element disposed in a subpixel due to foreign substances, and a subpixel including a defective circuit element may appear as a bright point or a dark point.

Accordingly, a method for detecting a defect in a circuit element disposed in each subpixel is required. However, there are problems that coordinates of a subpixel including a defective circuit element cannot be correctly detected and a defective circuit element from among circuit elements disposed in subpixels cannot be correctly determined.

Particularly, there is demand for a method for detecting defects in circuit elements generated after shipping of organic light emitting display devices and providing information about a circuit element detected as a defective circuit element and coordinates of a subpixel including the defective circuit element.

SUMMARY

An object of the present disclosure is to provide a display device and a driving method thereof which can detect a defect in a transistor disposed in each subpixel due to foreign substances.

Another object of the present disclosure is to provide a display device and a driving method thereof which can correctly extract coordinates at which a transistor detected as a defective transistor is disposed.

To accomplish the objects, an organic light emitting display device according to the present disclosure includes: an organic light emitting diode (OLED) disposed in a subpixel; a driving transistor electrically connected between the OLED and a driving voltage line; a scan transistor electrically connected between a first node through which a data voltage is applied to the driving transistor and a data line; a sensing transistor electrically connected between a second node between the driving transistor and the OLED and a reference voltage line; and a defect detector for applying the data voltage in a state in which both the scan transistor and the sensing transistor are turned off and then detecting an amount of charges charged in a parasitic capacitor of the OLED to determine whether the scan transistor disposed in the subpixel is defective.

In the organic light emitting display device according to the present disclosure, the scan transistor and the sensing transistor may be simultaneously turned on or simultaneously turned off.

In the organic light emitting display device according to the present disclosure, the amount of charges charged in the parasitic capacitor of the OLED may be proportional to an amount of current supplied from the driving transistor turned on by a leakage current applied to a gate electrode of the driving transistor even when the scan transistor is turned off when the data voltage is applied.

In the organic light emitting display device according to the present disclosure, the data voltage supplied through the data line in a state in which both the scan transistor and the sensing transistor are turned off may be higher than 0V.

In the organic light emitting display device according to the present disclosure, the defect detector may detect an amount of current charged in the parasitic capacitor of the OLED in a time period in which the sensing transistor is turned on when a voltage of 0V is applied to the data line.

In the organic light emitting display device according to the present disclosure, the defect detector may include a current comparator for comparing an amount of current charged in the parasitic capacitor of the OLED with a reference value, and an analog-to-digital converter for converting output result of the current comparator into a digital signal.

In the organic light emitting display device according to the present disclosure, the current comparator may include an operational amplifier receiving a voltage value corresponding to the amount of charges charged in the parasitic capacitor of the OLED through an inverting input terminal and receiving a reference voltage through a non-inverting input terminal, and a feedback capacitor connected between the inverting input terminal and an output terminal of the operational amplifier.

In the organic light emitting display device according to the present disclosure, a current conveyor for converting current corresponding to the amount of charges charged in the parasitic capacitor of the OLED into the voltage value may be connected to the inverting input terminal of the operational amplifier.

The organic light emitting display device according to the present disclosure may further include a memory for storing coordinates of a subpixel in which the scan transistor is defective.

The organic light emitting display device according to the present disclosure may further include a timing controller for processing a defective subpixel into a dark point using information stored in the memory.

A driving method of an organic light emitting display device according to the present disclosure includes: providing black data to a scan transistor and a sensing transistor simultaneously operating in a subpixel including an OLED to turn off a driving transistor; supplying a data voltage through a data line; and turning on both the scan transistor and the sensing transistor to detect an amount of charges charged in a parasitic capacitor of the OLED and determine whether the scan transistor is defective.

According to the organic light emitting display device and the driving method thereof according to the present disclosure, it is possible to detect a defect in a scan transistor disposed in a subpixel due to foreign substances by applying a data voltage to a data line and then determining whether charges are charged in a parasitic capacitor of an OLED when both the scan transistor and a sensing transistor disposed in the subpixel are turned off.

According to the organic light emitting display device and the driving method thereof according to the present invention, it is possible to prevent definition deterioration due to bright points by storing coordinate information of a subpixel including a defective transistor in a memory and processing the subpixel as a dark point.

DETAILED DESCRIPTION

Figure 1:
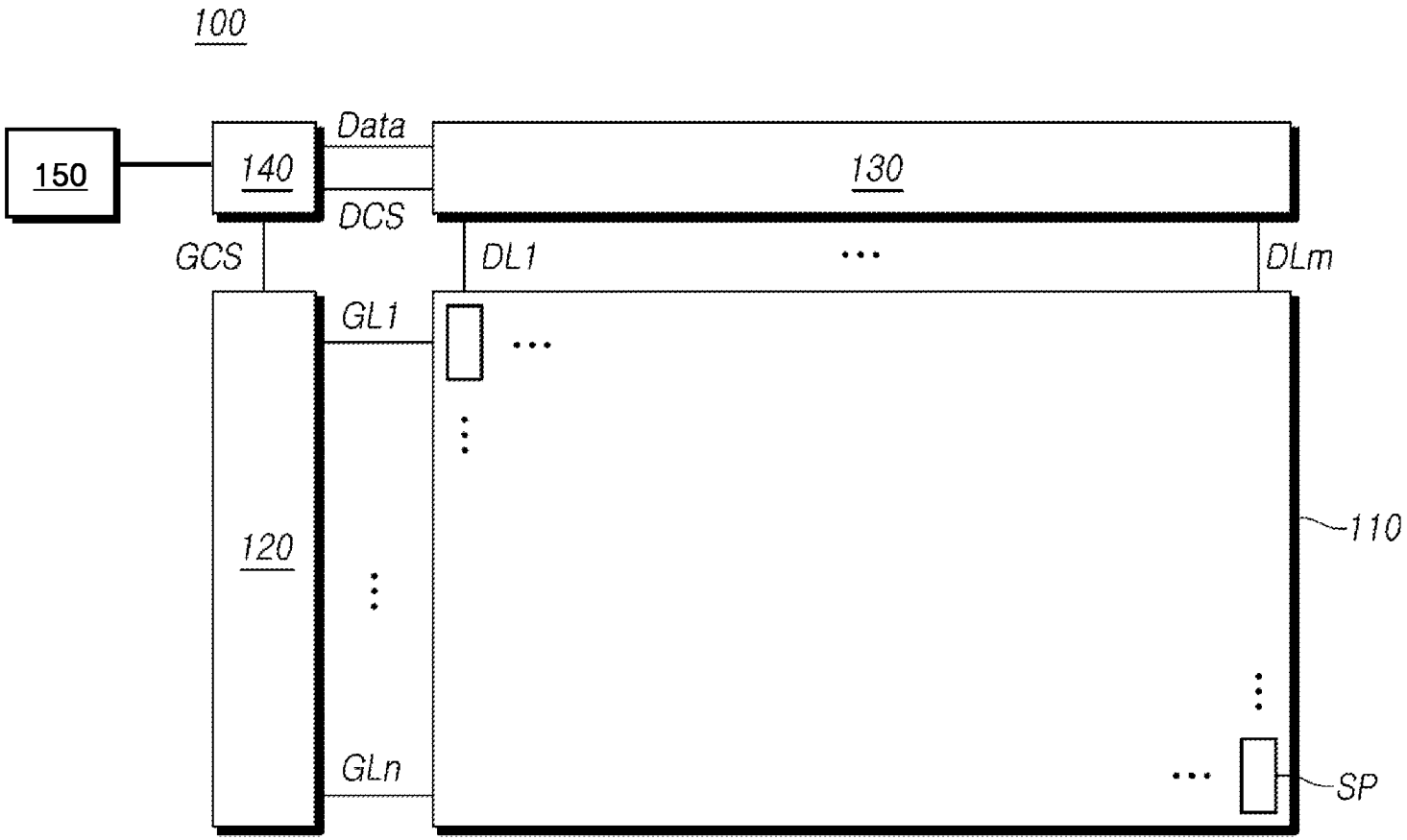
FIG. 1 is a diagram showing a schematic configuration of an organic light emitting display device according to an embodiment of the present disclosure.

For embodiments of the present invention disclosed in the description, specific structural and functional descriptions are exemplified for the purpose of describing embodiments of the present invention, and embodiments of the present invention can be implemented in various forms and are not to be considered as a limitation of the invention.

The present disclosure can be modified in various manners and have various forms and specific embodiments will be described in detail with reference to the drawings. However, the disclosure should not be construed as limited to the embodiments set forth herein, but on the contrary, the disclosure is to cover all modifications, equivalents, and alternatives falling within the spirit and scope of the embodiments.

While terms, such as "first", "second", etc., may be used to describe various components, such components must not be limited by the above terms. The above terms are used only to distinguish one component from another. For example, a first component may be referred to as a second component and the second component may be referred to as the first component without departing from the scope of the present invention.

When an element is "coupled" or "connected" to another element, it should be understood that a third element may be present between the two elements although the element may be directly coupled or connected to the other element. When an element is "directly coupled" or "directly connected" to another element, it should be understood that no element is present between the two elements. Other representations for describing a relationship between elements, that is, "between", "immediately between", "in proximity to", "in direct proximity to" and the like should be interpreted in the same manner.

The terms used in the specification of the present invention are merely used in order to describe particular embodiments, and are not intended to limit the scope of the present invention. An element described in the singular form is intended to include a plurality of elements unless the context clearly indicates otherwise. In the specification of the present invention, it will be further understood that the terms "comprise" and "include" specify the presence of stated features, integers, steps, operations, elements, components, and/or combinations thereof, but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which example embodiments pertain. It will be further understood that terms, such as those defined in commonly used dictionaries, should be interpreted as having a meaning that is consistent with their meaning in the context of the relevant art and should not be interpreted in an idealized or overly formal sense unless expressly so defined herein.

Meanwhile, when a certain embodiment can be implemented in a different manner, a function or an operation specified in a specific block may be performed in a different sequence from that specified in a flowchart. For example, two consecutive blocks may be simultaneously executed or reversely executed according to related function or operation.

In the following description, a pixel circuit and a gate driving circuit formed on a substrate of a display panel may be implemented by n-type or p-type transistors. For example, a transistor may be implemented by a MOSFET (metal oxide semiconductor field effect transistor). The transistor is a three-electrode element including a gate electrode, a source electrode, and a drain electrode. The source electrode is an electrode that provides carriers to the transistor. Carriers flow from the source in the transistor. The drain electrode is an electrode through which carriers are emitted in the transistor. For example, carriers flow from the source electrode to the drain electrode in the transistor. In the case of the n-type transistor, carriers are electrons and thus a source voltage is lower than a drain voltage such that the electrons can flow from the source to the drain. Since electrons flow from the source electrode to the drain electrode in the n-type transistor, current flows from the drain electrode to the source electrode. In the case of the p-type transistor, carriers are holes and thus a source voltage is higher than a drain voltage such that the holes can flow from the source electrode to the drain electrode. Since holes flow from the source electrode to the drain electrode in the p-type transistor, current flows from the source electrode to the drain electrode. The source electrode and the drain electrode of a transistor are not fixed and may be interchanged according to voltages applied thereto.

A gate on voltage may be a voltage of a gate signal at which a transistor can be turned on. A gate off voltage may be a voltage at which a transistor can be turned off. A gate on voltage of the p-type transistor may be a logic low voltage VL and a gate off voltage thereof may be a logic high voltage VH. A gate on voltage of the n-type transistor may be a logic high voltage and a gate off voltage thereof may be a logic low voltage.

Hereinafter, an organic light emitting display device and a driving method thereof according to the present invention will be described with reference to the attached drawings. FIG. 1 shows a schematic configuration of a display device 100 according to the present invention.

Referring to FIG. 1, the organic light emitting display device 100 according to the present embodiment includes a display panel 110 in which a plurality of gate lines GL (GL1 to GLn, n is a natural number), a plurality of data lines DL (DL1 to DLm, m is a natural number), and a plurality of subpixels SP are arranged, a gate driver 120 for driving the plurality of gate lines GL, a data driver 130 for driving the plurality of data lines DL, and a timing controller 140 for controlling the gate driver 120 and the data driver 130. The organic light emitting display device 100 may further include a memory 150.

The gate driver 120 sequentially drives the plurality of gate lines GL by sequentially supplying a scan signal to the plurality of gate lines GL.

The gate driver 120 sequentially drives the plurality of gate lines GL by sequentially supplying a scan signal at an on voltage or an off voltage to the plurality of gate lines GL according to control of the timing controller 140.

The gate driver 120 may be positioned only on one side or both sides of the display panel 110 according to driving mode.

In addition, the gate driver 120 may include one or more gate driver integrated circuits (ICs).

Each gate driver IC may be connected to a bonding pad of the display panel 110 through tape automated bonding (TAB) or chip on glass (COG) or implemented as a gate-in-panel (GIP) type and directly disposed on the display panel 110.

Further, each gate driver IC may be integrated in the display panel 110 or implemented as a chip on film (COF) mounted on a film connected to the display panel 110.

The data driver 130 drives the plurality of data lines DL by supplying a data voltage to the plurality of data lines DL.

When a specific gate line GL is open, the data driver 130 converts image data Data received from the timing controller 140 into an analog data voltage and supplies the analog data voltage to the plurality of data lines DL to drive the data lines DL.

The data driver 130 may include at least one source driver integrated circuit (IC) to drive the plurality of data lines DL.

Each source driver IC may be connected to a bonding pad of the display panel 110 through tape automated bonding (TAB) or chip on glass (COG), directly disposed in the display panel 110, or integrated in the display panel 110.

Further, each source driver IC may be implemented as a chip on film (COF). In this case, one end of each source driver IC is bonded to a source printed circuit board and the other end thereof is bonded to the display panel 110.

The timing controller 140 supplies various control signals to the gate driver 120 and the data driver 130 to control the gate driver 120 and the data driver 130.

The timing controller 140 starts scanning at a timing of each frame, converts externally input image data into a data signal format used in the data driver 130, outputs the converted image data, and controls data driving at an appropriate time in accordance with scanning.

The timing controller 140 receives various timing signals including a vertical synchronization signal Vsync, a horizontal synchronization signal Hsync, an input data enable signal DE, and a clock signal CLK from an external device (e.g., a host system) along with input image data.

In addition to the operation of converting externally input image data into the data signal format used in the data driver 130 and outputting the converted image data, the timing controller 140 receives timing signals such as the vertical synchronization signal Vsync, the horizontal synchronization signal Hsync, the input data enable signal DE, and the clock signal CLK, generates various control signals and outputs the control signals to the gate driver 120 and the data driver 130 to control the gate driver 120 and the data driver 130.

For example, the timing controller 140 outputs various gate control signals GCS including a gate start pulse signal GSP, a gate shift clock signal GSC, and a gate output enable signal GOE in order to control the gate driver 120.

Here, the gate start pulse signal GSP controls operation start timing of one or more gate driver ICs constituting the gate driver 120. The gate shift clock signal GSC is a clock signal commonly input to the one or more gate driver ICs and controls a scan signal (gate pulse) shifting timing. The gate output enable signal GOE designates timing information of the one or more gate driver ICs.

In addition, the timing controller 140 outputs various data control signals DCS including a source start pulse signal SSP, a source sampling clock signal SSC, and a source output enable signal SOE in order to control the data driver 130.

Here, the source start pulse signal SSP controls a data sampling start timing of one or more source driver ICs constituting the data driver 130. The source sampling clock signal SSC is a clock signal for controlling a data sampling timing in each source driver IC. The source output enable signal SOE controls an output timing of the data driver 130.

The timing controller 140 may be disposed on a control printed circuit board connected to a source printed circuit board to which the source driver ICs are bonded through a connecting medium such as a flexible flat cable (FFC) or a flexible printed circuit (FPC).

The control printed circuit board may further include a power controller (not shown) disposed thereon which supplies various voltages or currents to the display panel 110, the gate driver 120 and the data driver 130 or controls various voltages or currents to be supplied thereto. The power controller may also be called a power management IC. Subpixels disposed in the display panel 110 of the display device 100 may include circuit elements such as a transistor and a capacitor, and when the display device 100 is an organic light emitting display device, each subpixel may include circuit elements such as an OLED, two or more transistors and at least one capacitor.

The types and number of circuit elements constituting each subpixel may be determined in various manners according to functions provided by the circuit elements and circuit element design methods.

Figure 2:
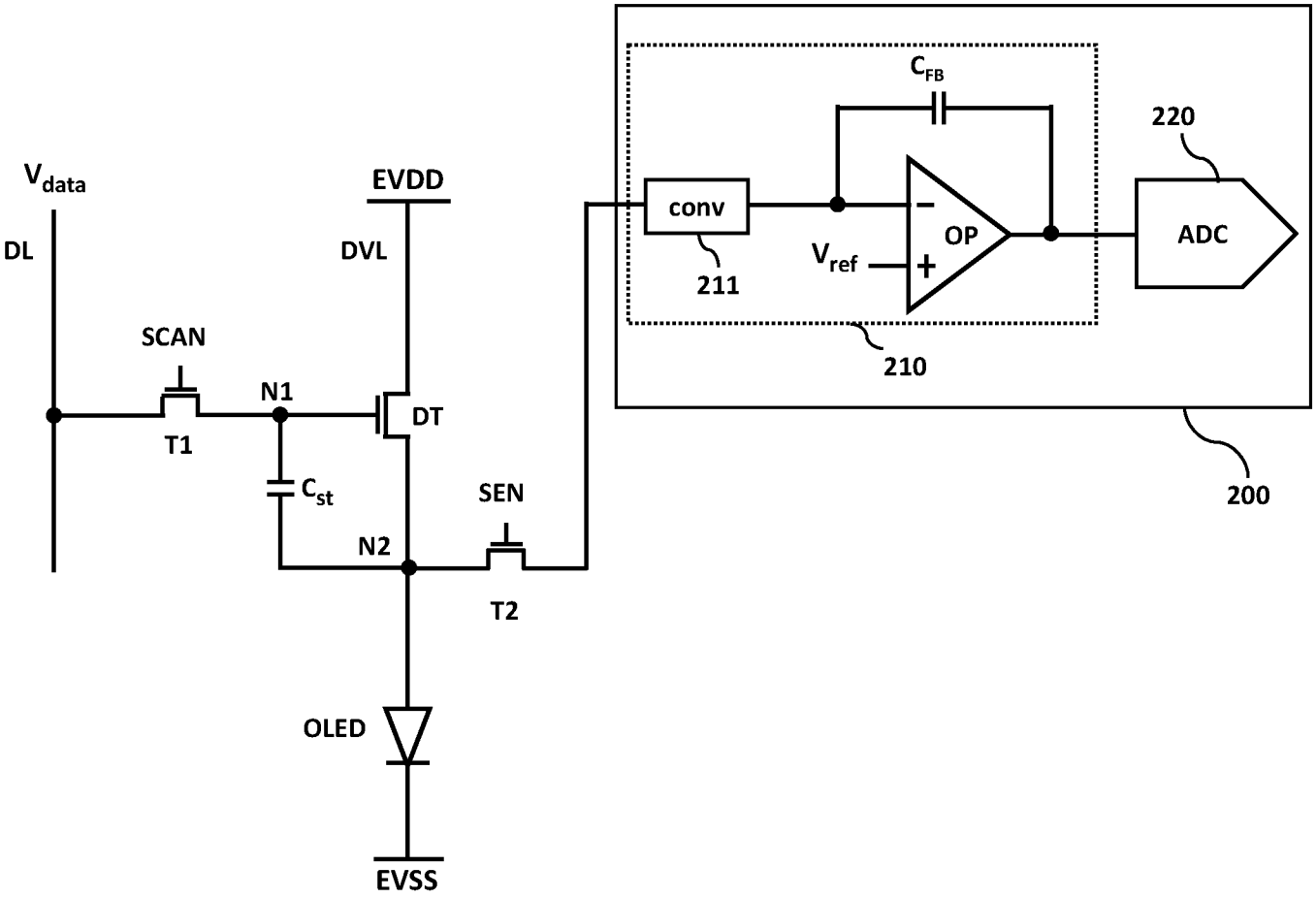
FIG. 2 is a diagram showing a configuration of detecting a defect in a transistor disposed in a subpixel in the organic light emitting display device according to an embodiment of the present disclosure.

FIG. 2 is a diagram showing a configuration of detecting a defect in a transistor disposed in a subpixel in an organic light emitting display device according to an embodiment of the present disclosure. Referring to FIG. 2, each subpixel includes an OLED, a driving transistor DT electrically connected between the OLED and a driving voltage line DVL, a scan transistor T1 electrically connected between a first node N1 through which a data voltage Vdata is applied to the driving transistor DT and a data line DL, a sensing transistor T2 connected to a second node N2 between the driving transistor DT and the OLED and used to sense deterioration of a circuit element such as the OLED or the driving transistor DT included in the subpixel, and a defect detector 200 which applies a data voltage in a state in which both the scan transistor T1 and the sensing transistor T2 are turned off and then detects the amount of charges charged in a parasitic capacitor $C_{OLED}$ (see FIG. 4) of the OLED to determine whether the scan transistor T1 disposed in the subpixel is defective.

The OLED includes a first electrode (e.g., anode electrode or cathode electrode), an organic layer, and a second electrode (e.g., cathode electrode or anode electrode). The first electrode of the OLED may be connected to the second node N2 of the driving transistor DT and a ground voltage EVSS may be applied to the second electrode of the OLED.

The driving transistor DT supplies a driving current to the OLED to drive the OLED and includes the first node N1 corresponding to a gate node, the second node N2 corresponding to a source node, and a drain node to which a high voltage EVDD is applied.

The driving voltage EVDD may be applied to the driving voltage line DVL and the ground voltage EVSS may be applied to the second electrode of the OLED.

The scan transistor T1 transfers a data voltage to the first node N1 of the driving transistor DT. The scan transistor T1 may be electrically connected between the first node N1 of the driving transistor DT and the data line DL and turned on by a scan signal SCAN applied to the gate node thereof to transfer the data voltage to the first node N1 of the driving transistor DT.

A storage capacitor $C_{st}$ is electrically connected between the first node N1 and the second node N2 of the driving transistor DT.

The storage capacitor $C_{st}$ is electrically connected between the first node N1 and the second node N2 of the driving transistor DT to maintain a specific voltage for one frame.

The sensing transistor T2 may be used to sense deterioration of a circuit element such as the OLED or the driving transistor DT included in the subpixel according to a sense signal applied thereto.

Accordingly, the aforementioned transistors disposed in the subpixel need to operate such that the OLED included in the subpixel can correctly represent grayscales according to data.

The defect detector 200 includes a current comparator 210 which compares the amount of current charged in the parasitic capacitor $C_{OLED}$ of the OLED with a reference value, and an analog-to-digital converter ADC 220 which converts output result of the current comparator 210 into a digital signal.

Further, the current comparator 210 includes an operational amplifier OP which receives a voltage value corresponding to the amount of charges charged in the parasitic capacitor $C_{OLED}$ of the OLED through an inverting input terminal and receives a reference voltage Vref through a non-inverting input terminal, and a feedback capacitor $C_{FB}$ connected between the inverting input terminal and an output terminal of the OP.

A current conveyor cony 211 which converts a current corresponding to the amount of charges charged in the parasitic capacitor $C_{OLED}$ of the OLED into a voltage value is connected to the inverting input terminal of the OP.

In the organic light emitting display device according to the present disclosure, the scan transistor T1 and the sensing transistor T2 are provided with the same logic voltage or opposite voltages such that they are simultaneously turned on or turned off. For example, one of the two transistors may be configured as an n-type or p-type transistor or both the transistors may be configured as an n-type or p-type transistor.

When a defect is generated in the scan transistor due to foreign substances, a bright-point defective subpixel having a different luminance is generated. The present disclosure provides a method for detecting a defect in the scan transistor T1 in the aforementioned subpixel structure and a method for correctly detecting coordinates of a subpixel including a defective transistor using the same.

Figure 3:
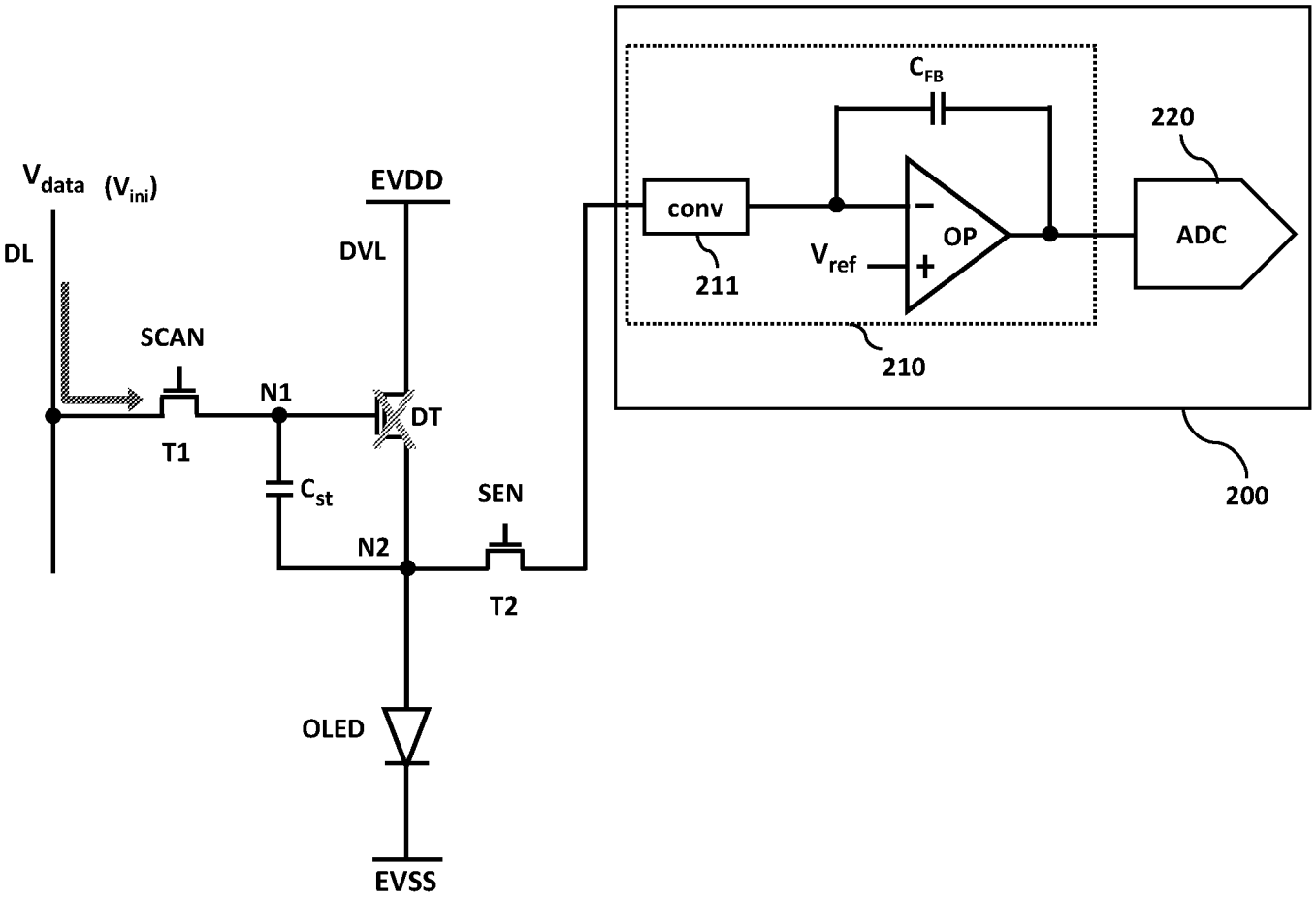
FIG. 3 is a diagram showing an initialization stage for detecting a defect in a transistor in the organic light emitting display device according to an embodiment of the present disclosure.
Figure 4:
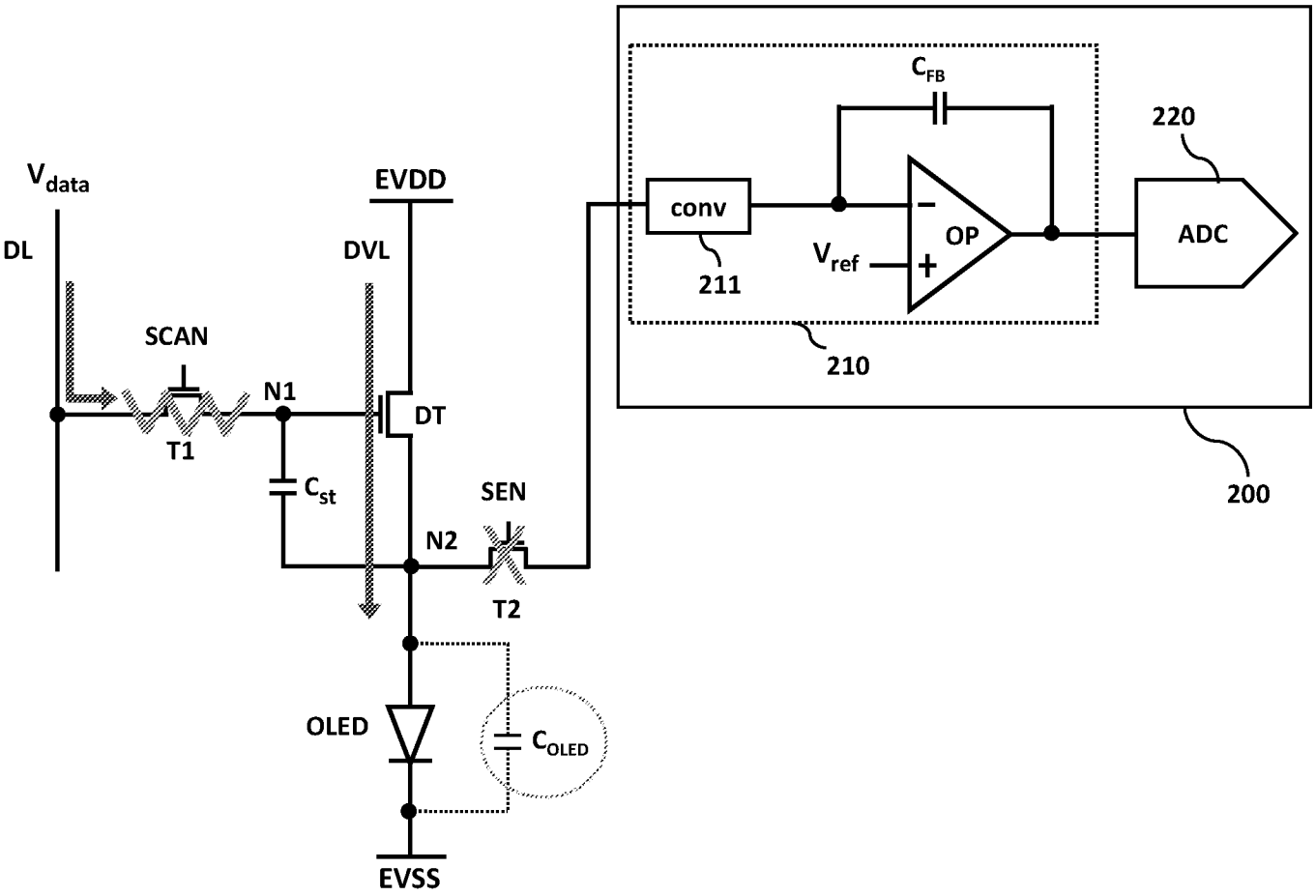
FIG. 4 illustrates an operation example when a data voltage is applied to detect a defect in a transistor in the organic light emitting display device according to an embodiment of the present disclosure.
Figure 5:
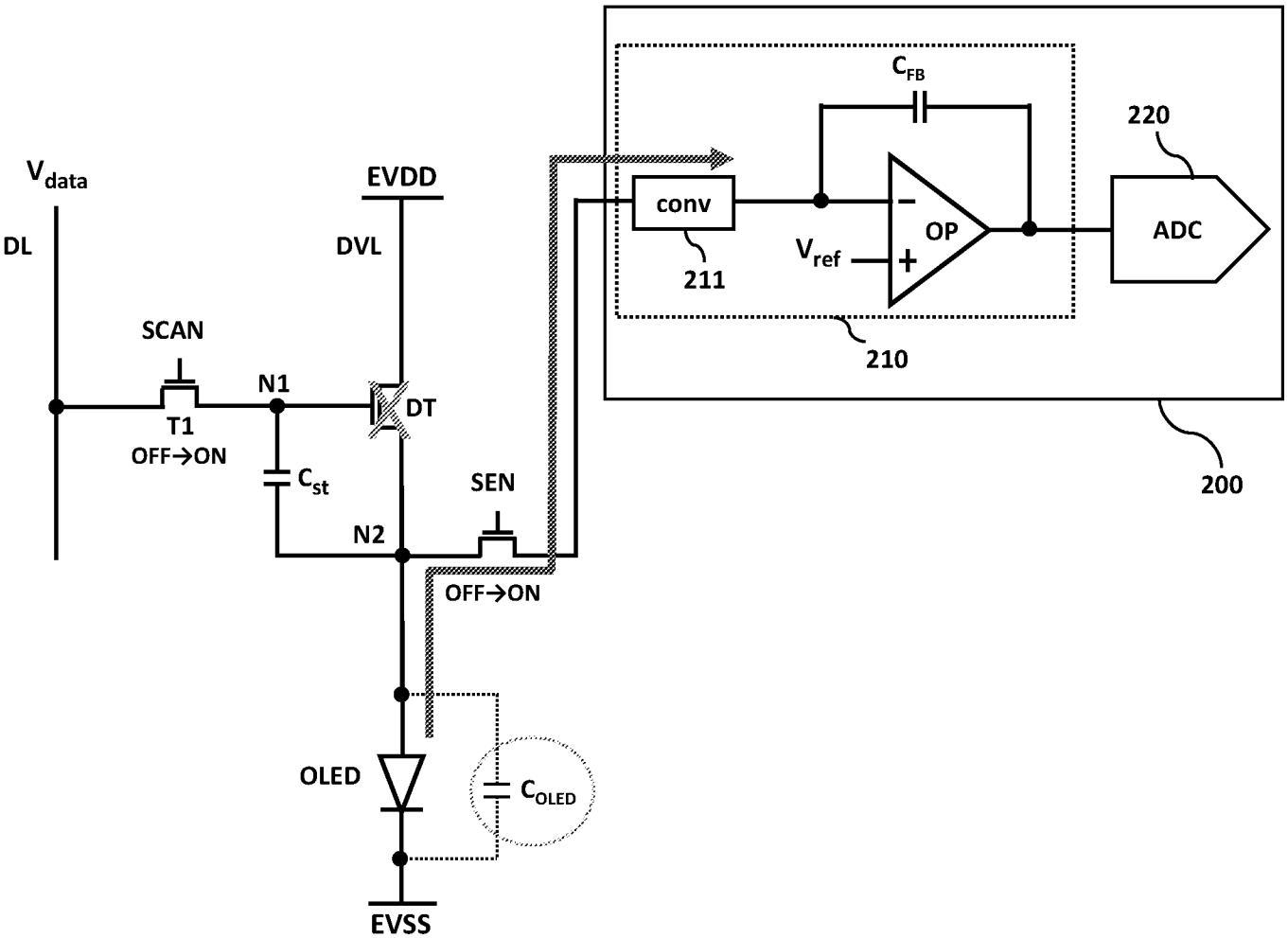
FIG. 5 illustrates an operation example when a driving signal is applied to a scan transistor and a sensing transistor to detect a defect in a transistor in the organic light emitting display device according to an embodiment of the present disclosure.
Figure 6:
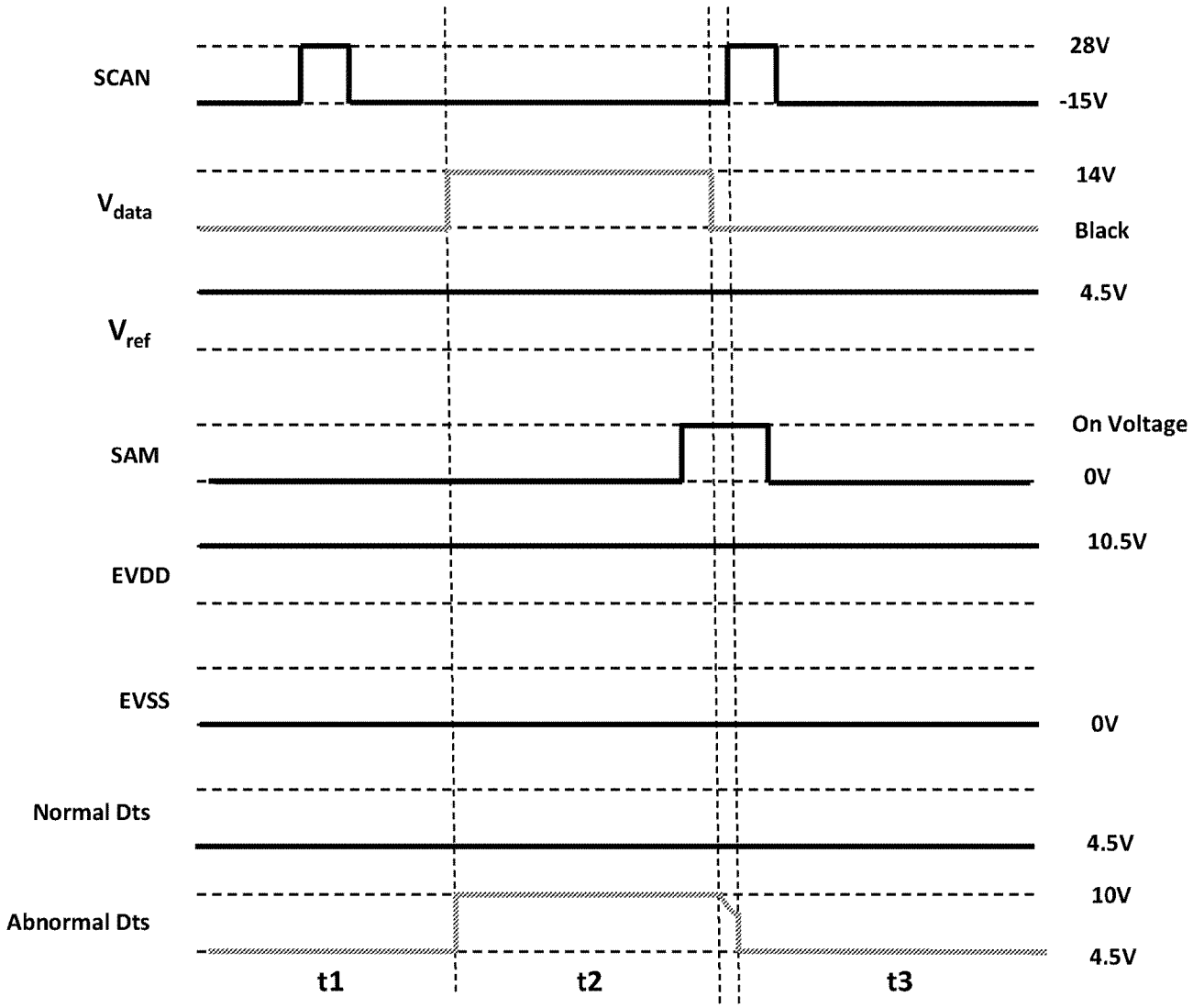
FIG. 6 is a waveform diagram of signals provided to components to detect a defect in a transistor in the organic light emitting display device according to an embodiment of the present disclosure.

FIG. 3 is a diagram showing an initialization stage for detecting a defect in a transistor in the display device according to an embodiment of the present disclosure, FIG. 4 illustrates an operation example when a data voltage is applied to detect a defect in a transistor in the display device according to an embodiment of the present disclosure, FIG. 5 illustrates an operation example when a driving signal is applied to a scan transistor and a sensing transistor to detect a defect in a transistor in the display device according to an embodiment of the present disclosure, and FIG. 6 is a waveform diagram of signals provided to components to detect a defect in a transistor in the display device according to an embodiment of the present disclosure.

First, in an initialization period t1, black data, for example, Vdata SEN of "0" V, is respectively provided to the scan transistor T1 and the sensing transistor T2, which simultaneously operate, as shown in FIG. 3. In this initialization stage, a logic low voltage VL is applied to the gate electrode of the driving transistor DT such that the driving transistor DT is turned off. Accordingly, no current flows to the parasitic capacitor $C_{OLED}$ of the OLED and thus the amount of current (charge) charged in the parasitic capacitor is "0".

In this initialized state, a very high voltage (e.g., 14V) is applied to a data line DL through which a data voltage Vdata is supplied for a second period t2, as shown in FIG. 4. If the scan transistor T1 is in a normal state, current is not supplied through the source electrode of the scan transistor T1 even when a high voltage is supplied through the drain electrode.

However, when the scan transistor T1 is defective, current is supplied through the source electrode of the scan transistor T1 due to leakage. Accordingly, the potential of the first node connected to the gate electrode of the driving transistor DT increases and thus the driving transistor DT is turned on. The current supplied through the source electrode of the driving transistor DT is charged in the parasitic capacitor $C_{OLED}$ of the OLED because the sensing transistor T2 is turned off. Here, the amount charged is proportional to the amount of current supplied from the driving transistor turned on by leakage current applied to the gate electrode of the driving transistor even though the scan transistor is turned off.

In this state, when a sampling signal SAM is provided in a sensing period t3, the defect detector 200 operates so that 0V is applied through the data line and the scan transistor T1 and the sensing transistor T2 are turned on. Here, the charges charged in the parasitic capacitor $C_{OLED}$ of the OLED are provided to the defect detector 200, as shown in FIG. 5.

The charges charged in the parasitic capacitor $C_{OLED}$ of the OLED are converted into a voltage value through the current conveyor 211 and transferred to the inverting input terminal of the OP. The OP amplifies a difference between the voltage value and a reference voltage Vref applied to the non-inverting input terminal and outputs the amplified voltage through the output terminal. The value output through the output terminal of the OP is converted into a digital signal through the ADC 220. This digital signal is transmitted to the timing controller 140. The timing controller 140 recognizes coordinates of the corresponding subpixel and stores the coordinates in the memory 150 such that the subpixel is processed into a dark point.

Figure 7:
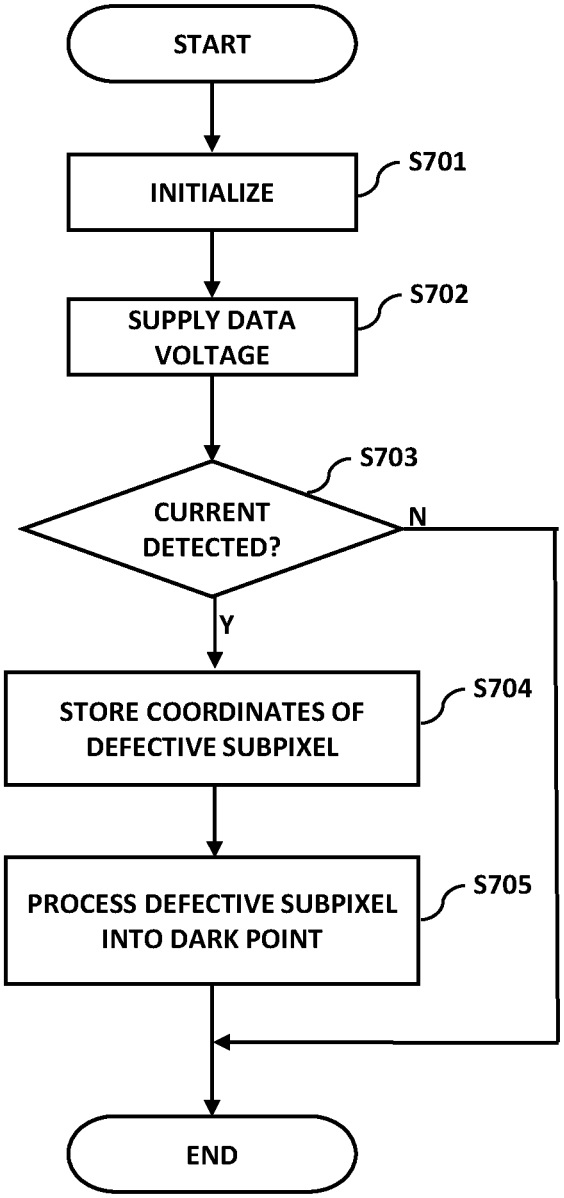
FIG. 7 is a flowchart showing a process of a driving method of the organic light emitting display device according to an embodiment of the present disclosure.

FIG. 7 is a flowchart showing a process of a driving method of the display device according to an embodiment of the present invention. The scan transistor T1 and the sensing transistor T2 which simultaneously operate are turned on in the initialization period t1, and black data of 0V is provided through the data line DL. Accordingly, the driving transistor DT is turned off and thus the potentials of the nodes N1 and N2 connected to the gate electrode and the source electrode of the driving transistor DT are initialized (S701).

In a state in which both the scan transistor T1 and the sensing transistor T2 are turned off, a very high data voltage (a voltage greater than 0V) is supplied through the data line DL. If the scan transistor T1 is normal, the driving transistor DT maintains a turned-off state. However, if the scan transistor T1 is abnormal, the potential of the first node N1 connected to the gate electrode of the driving transistor DT increases due to leakage to cause the driving transistor DT to be turned on. Accordingly, a driving voltage VDD is supplied through the drain electrode of the driving transistor DT. As the driving transistor DT is turned on, current provided through the source electrode is charged in the parasitic capacitor $C_{OLED}$ of the OLED (S702).

A sampling signal for driving the defect detector 200 is provided to check whether a current is detected through the defect detector 200 while both the scan transistor T1 and the sensing transistor T2 are turned on (S703).

If no charges are charged in the parasitic capacitor $C_{OLED}$ of the OLED, the scan transistor T1 is normal because a voltage output through the current comparator 210 of the defect detector 200 does not correspond to the reference value. However, when the scan transistor T1 is defective, charges charged in the parasitic capacitor $C_{OLED}$ of the OLED due to leakage are output as a predetermined value through the current comparator 210. This value is converted into a digital signal through the ADC 220 and transmitted to the timing controller 140. The timing controller 140 stores coordinate information of the corresponding subpixel in the memory 150 (S704).

Since a subpixel having a defective scan transistor T1 operates as a bright point, the timing controller 140 reads information about the subpixel from the memory 150 and processes the subpixel into a dark point such that a data voltage is not provided to the subpixel (S705).

As described above, the present disclosure can detect a defect in a scan transistor included in a subpixel due to foreign substances by applying a high data voltage to a data line and then determining whether charges are charged in a parasitic capacitor of an OLED when both the scan transistor and a sensing transistor included in the subpixel are turned off.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display device, comprising:
- an organic light emitting diode (OLED) disposed in a subpixel;
- a driving transistor electrically connected between the OLED and a driving voltage line;
- a scan transistor electrically connected between a first node and a data line, wherein the first node applies a data voltage to the driving transistor;
- a sensing transistor electrically connected between a second node and a reference voltage line, wherein the second node is disposed between the driving transistor and the OLED; and
- a defect detector for:
  - initiating by providing black data for turning off the driving transistor through a data line in a state in which both the scan transistor and the sensing transistor are turned on and then,
  - applying the data voltage that is greater than the black data through a data line in a state in which both the scan transistor and the sensing transistor are turned off and then,
  - applying the black data through a data line and detecting an amount of current at the second node in a time period in which the sensing transistor is turned on when the black data is applied to the data line to determine whether the scan transistor is defective.

2. The organic light emitting display device of claim 1, wherein the scan transistor and the sensing transistor are simultaneously turned on or simultaneously turned off.

3. The organic light emitting display device of claim 1, wherein the amount of current at the second node is proportional to an amount of current supplied from the driving transistor being turned on by a leakage current applied to a gate electrode of the driving transistor even when the scan transistor is turned off when the data voltage is applied.

4. The organic light emitting display device of claim 1, further comprising a memory for storing coordinates of a subpixel in which the scan transistor is defective.

5. The organic light emitting display device of claim 4, further comprising timing controller for processing a defective subpixel into a dark point using information stored in the memory.

6. The organic light emitting display device of claim 1, wherein the defect detector comprises:
- a current comparator for comparing the amount of current at the second node to a reference value; and
- an analog-to-digital converter for converting output result of the current comparator into a digital signal.

7. The organic light emitting display device of claim 6, wherein the current comparator comprises:
- an operational amplifier receiving a voltage value corresponding to the amount of current at the second node through an inverting input terminal and receiving a reference voltage through a non-inverting input terminal; and a feedback capacitor connected between the inverting input terminal and an output terminal of the operational amplifier.

8. The organic light emitting display device of claim 7, wherein the current comparator further comprises a current conveyor connected to the inverting input terminal of the operational amplifier and wherein the current conveyor converts current corresponding to the amount of current at the second node.

9. A driving method of an organic light emitting display device, comprising:

initiating by providing black data for turning off a driving transistor through a data line in a state in which both a scan transistor and a sensing transistor are turned on;

supplying a data voltage that is greater than the black data through a data line in a state in which both the scan transistor and the sensing transistor are turned off; and applying the black data through a data line and detecting an amount of current at a node in a time period in which the sensing transistor is turned on when the black data is applied to the data line; and determining whether the scan transistor is defective corresponding to the amount of current at the node.

10. The driving method of claim 9, wherein the amount of current at the node is proportional to an amount of current supplied from the driving transistor being turned on even when the scan transistor is turned off when the data voltage is applied.

11. The driving method of claim 9, wherein the detecting of the amount of current at the node comprises comparing an amount of current at the node with a reference value using a current comparator.

12. The driving method of claim 9, further comprising:

storing coordinates of a subpixel in which the scan transistor is defective in a memory; and processing a defective subpixel corresponding to coordinates stored in the memory into a dark point.

* * * * *